US005443253A

United States Patent [19]

Dale et al.

[11] Patent Number: 5,443,253

[45] Date of Patent: Aug. 22, 1995

[54] REMITTANCE PROCESSING APPARATUS AND METHOD

[75] Inventors: Amarjit Dale, Fremont; George H. Bingham, Los Altos, both of Calif.

[73] Assignee: Omation Corporation, Mountain View, Calif.

[21] Appl. No.: 151,250

[22] Filed: Nov. 12, 1993

[51] Int. Cl.[6] ..... B65H 29/38

[52] U.S. Cl. ..... 271/177; 271/122; 271/182; 271/189; 271/215; 271/219

[58] Field of Search ..... 271/121, 122, 243, 177, 271/181, 182, 189, 192, 215, 219, 214, 190, 265

[56] References Cited

U.S. PATENT DOCUMENTS

| | | | |
|---|---|---|---|
| 3,205,794 | 9/1965 | Califano et al. | 271/192 |
| 3,302,948 | 2/1967 | May | 271/177 |
| 3,659,841 | 5/1972 | Rigotti | 271/219 |
| 4,524,965 | 6/1985 | Kulpa | 271/219 |
| 4,809,966 | 3/1989 | Kobayashi et al. | 271/214 |
| 5,056,432 | 10/1991 | Sugimoto et al. | 271/215 |
| 5,147,092 | 9/1992 | Driscoll et al. | 271/245 |
| 5,224,697 | 7/1993 | Darchis et al. | 271/215 |

*Primary Examiner*—H. Grant Skaggs

*Attorney, Agent, or Firm*—Flehr, Hohbach, Test, Albritton & Herbert

[57] ABSTRACT

Remittance processing apparatus and method in which the leading edges of a pair of documents such as a payment coupon and a check conveyed along a path are engaged with a gate to control passage of the documents along the path. The gate is held in a closed position until the leading edges are aligned with each other and thereafter opened to release the documents. The documents are then engaged by feed rollers rotating at speeds such that one of the two documents is fed ahead of the other to a stacking tray with a stacking belt which engages one side of the documents. The tray is urged toward the belt with a force which remains substantially constant regardless of the number of documents stacked in the tray.

12 Claims, 3 Drawing Sheets

REMITTANCE PROCESSING APPARATUS AND METHOD

This invention pertains generally to mail processing equipment and, more particularly to apparatus and a method of processing documents such as remittance coupons and checks extracted from envelopes.

Many banks and other businesses receive monthly payments from their customers through the mail in the form of checks and payment coupons in envelopes which they have provided. In order to process large volumes of such mail efficiently, a number of machines have been provided to open the envelopes and facilitate the removal of the contents therefrom. All of the machines heretofore provided for this purpose, however, have had certain limitations and disadvantages.

U.S. Pat. Nos. 3,979,884, 4,139,977, 4,159,611, 4,271,656, 4,319,444 and 4,333,300 disclose envelope processing machines in which the envelopes are serially presented to a station in the machine where the contents are manually removed by an operator. The front and rear panels of the envelopes are held apart by suction cups to make it easier for the operator to grasp the contents. These machines generally cannot deliver the contents to a station located on or above the operator's desk or other work station, and the operator must turn away from the desk or work station in order to get to the station where the contents are presented. In addition, the operator must manually remove the contents from the envelopes.

U.S. Pat. No. 3,884,010 discloses an envelope opening and emptying machine which cuts off the two ends of an envelope, then turns the envelope to a vertical position so that the contents will fall out by gravity.

U.S. Pat. Nos. 3,797,350, 4,527,455 and 4,553,459 disclose machines for opening envelopes. In U.S. Pat. No. 3,797,350, the envelopes are conveyed in successive order transversely through the teeth of a cutter similar to a circular saw blade to cut open one edge of each envelope. In U.S. Pat. No. 4,527,455, the ends of the envelopes are cut off in a shearing action by knife blades, and in U.S. Pat. No. 4,553,459 the envelope is rotated to present successive edges to a cutter.

U.S. Pat. Nos. 4,016,708 and 4,295,321 disclose envelope opening machines having an extractor for removing contents from envelopes. In U.S. Pat. No. 4,016,708, the envelopes are opened by a so-called "chadless cutter" which cuts through only one panel of each envelope, with the other panel remaining intact, while in U.S. Pat. No. 4,295,321, the ends of the envelopes are severed by cutting wheels in a shearing action. In both patents, the envelopes are separated from the contents by a vacuum drum, and the contents are discharged toward the front of the machine, where they are picked up manually by the operator.

U.S. Pat. No. 5,156,515 shows an extractor which opens the envelopes, removes the contents, and presents the contents from one envelope at a time to a work station. In the system described in that particular patent, the presence of contents at the work station is monitored, and the contents from each successive envelope are delivered to the work station where the contents from the previous envelope are removed so that an operator at the work station is presented with the contents from only one envelope at a time.

It is in general an object of the invention to provide a new and improved apparatus and method for processing documents such as remittance coupons and checks which have been extracted from envelopes.

Another object of the invention is to provide an apparatus and method of the above character which overcome limitations and disadvantages of mail processing equipment of the prior art.

Another object of the invention is to provide an apparatus and method of the above character which are particularly suitable for use in stacking contents removed from envelopes.

These and other objects are achieved in accordance with the invention by providing a remittance processing apparatus and method in which the leading edges of a pair of documents such as a payment coupon and a check conveyed along a path are engaged with a gate to control passage of the documents along the path. The gate is held in a closed position until the leading edges are aligned with each other and thereafter opened to release the documents. The documents are then engaged by feed rollers rotating at speeds such that one of the two documents is fed ahead of the other to a stacking tray with a stacking belt which engages one side of the documents. The tray is urged toward the belt with a force which remains substantially constant regardless of the number of documents stacked in the tray.

Figure 1:
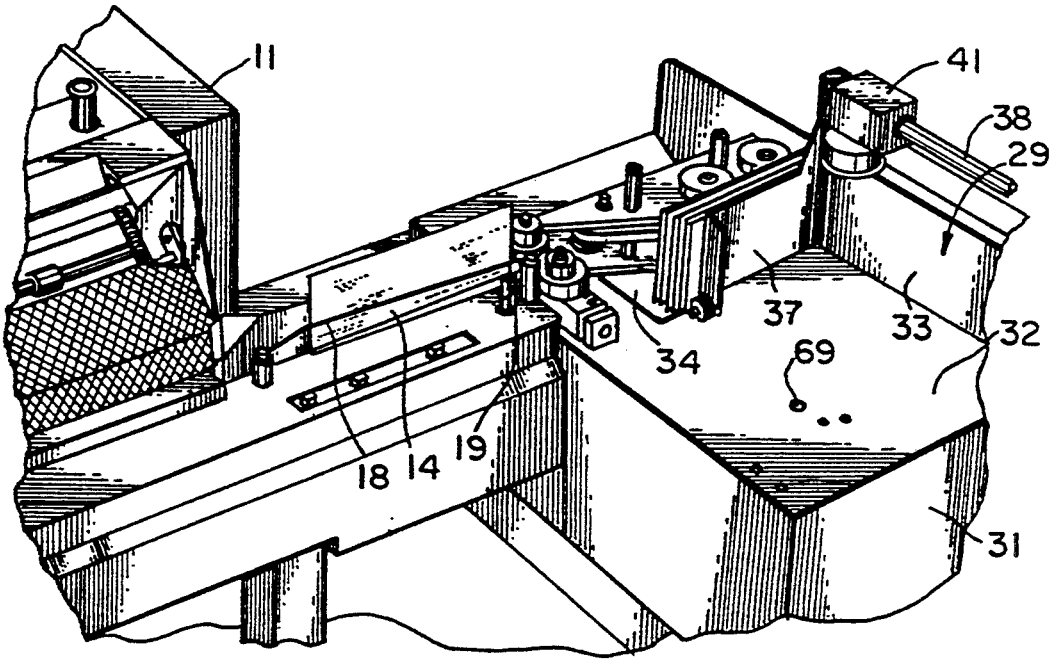
FIG. 1 is an isometric view of one embodiment of remittance process apparatus according to the invention.
Figure 3:
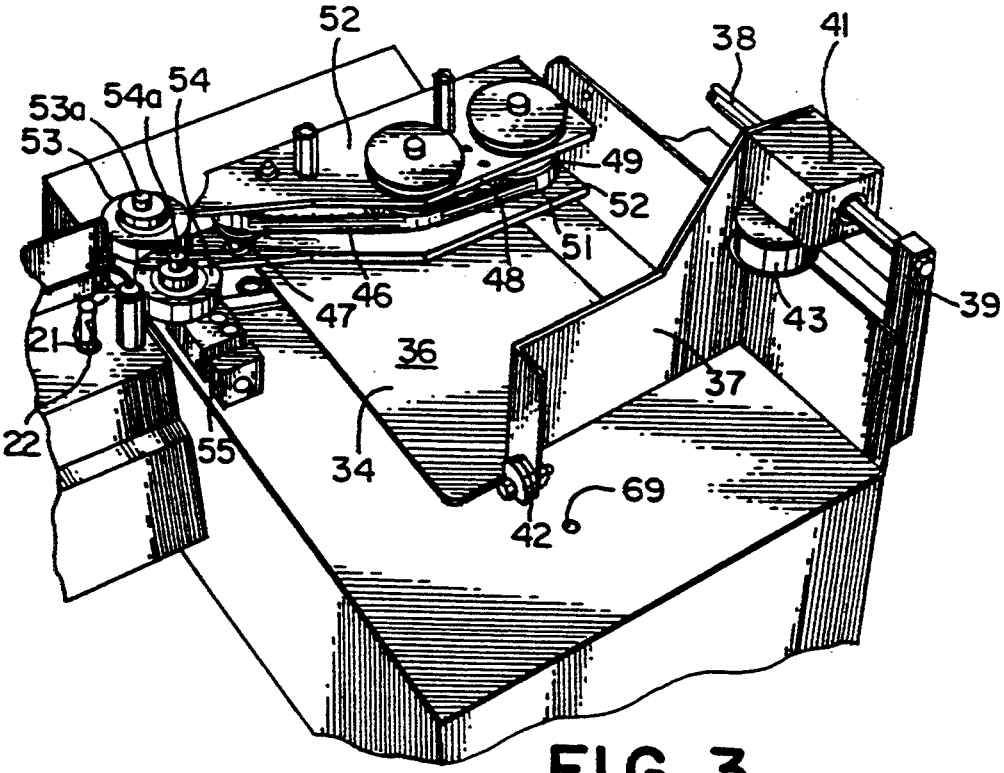
FIG. 3 is an isometric view of a portion of the embodiment of FIG. 1.

In the drawings, the invention is illustrated in connection with an extractor 11 of the type shown in U.S. Pat. No. 5,156,515. Briefly, in this extractor, envelopes to be processed are stacked at an input station and fed one at a time from the input station to a cutting station. At the cutting station, the envelopes are severed along edge portions thereof to provide access to the contents, and the envelopes and contents are transported from the cutting station to a separating station, where the contents are removed from the envelopes. The contents from one envelope at a time are then conveyed along an output conveyor which comprises a horizontally extending belt 12 trained about drive pulleys 13.

Contents such as a payment coupon 14 and a check 16 stand upon their lower edges in a generally upright position on belt 12 and slide along a back rest 17. A guide rail 18 extends in front of the belt to prevent the contents from falling forward.

Means is provided for aligning the leading edges of the two documents before they leave the conveyor. This means includes a gate 19 consisting of a radially extending arm 21 affixed to the shaft 22 of a rotary solenoid 23. The gate has a closed position shown in solid lines in FIG. 2 and an open position shown in phantom lines. In the closed position, the arm extends across the belt at an angle and through a notch 24 in the edge of the back rest in position to engage the leading edges of the documents and retain them until the gate is opened. In the open position, the gate arm is rotated away from the back rest, and the documents are free to travel with the belt.

A sensor 26 is positioned along the path of the belt at a point ahead of the gate to detect the presence of contents at that point. A timer 27 is connected between the sensor and the solenoid. When the leading edge of the first document passes the sensor, the solenoid is actuated to close the gate, and that document will stop when it abuts against the gate arm. When the trailing edge of the last document passes the sensor, the timer is triggered to actuate the solenoid to open the gate after a predetermined period of time. That period is selected to be long enough to permit the leading edge of the trailing document to reach the gate arm and come into alignment with the leading edge of the other document before the gate opens.

Figure 2:
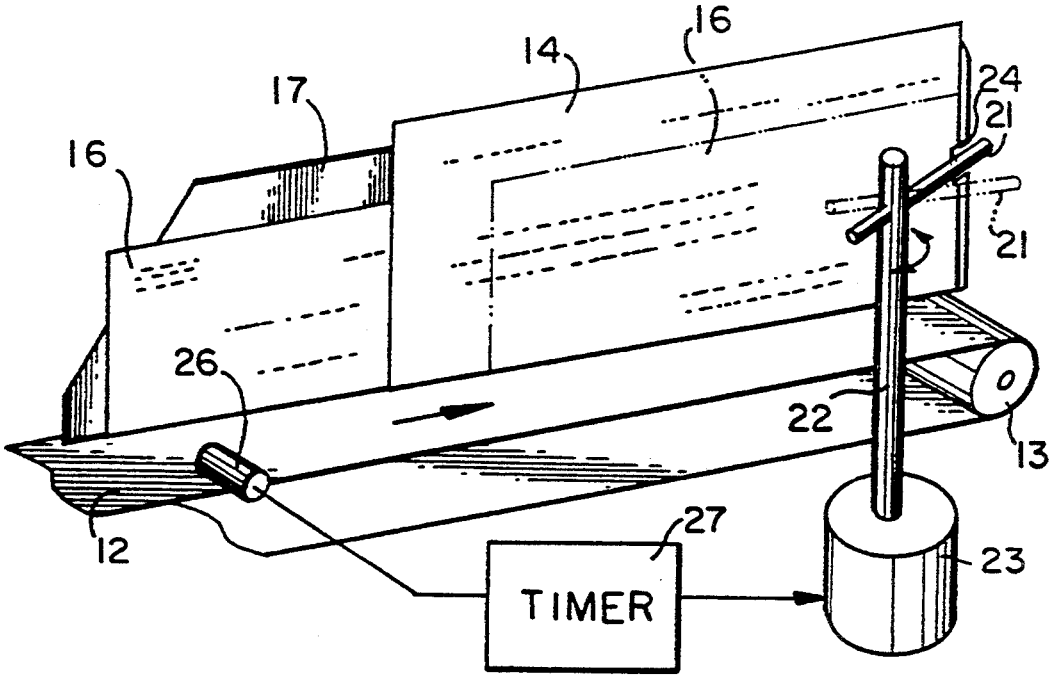
FIG. 2 is a fragmentary isometric view, somewhat schematic, of a portion of the embodiment of FIG. 1.
Figure 4:
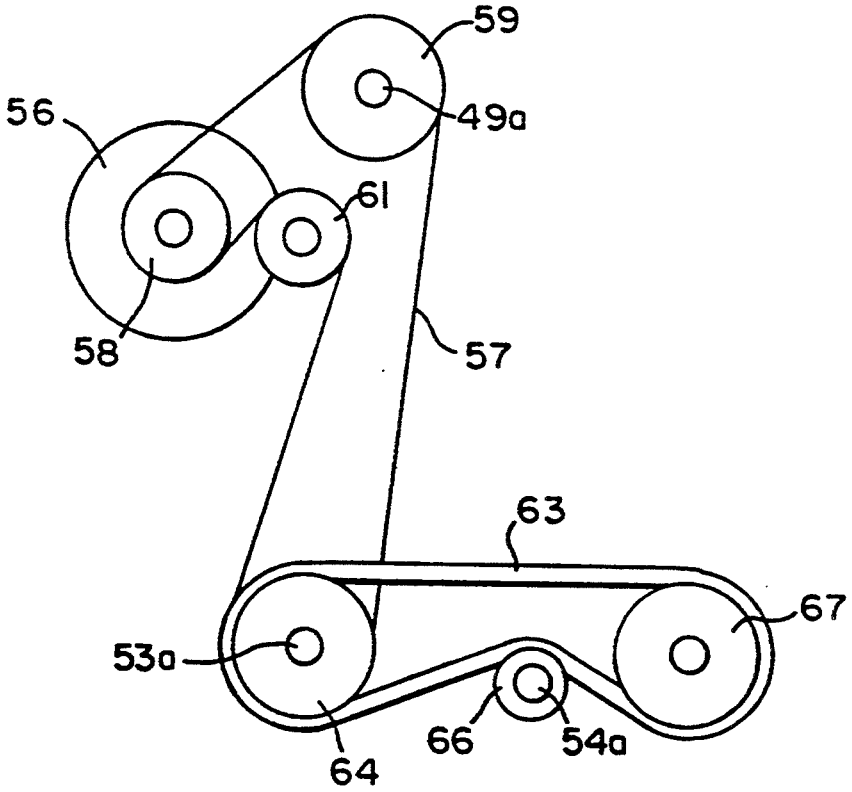
FIG. 4 is a top plan view, somewhat schematic, of a portion the drive mechanism in the embodiment of FIG. 1.
Figure 5:
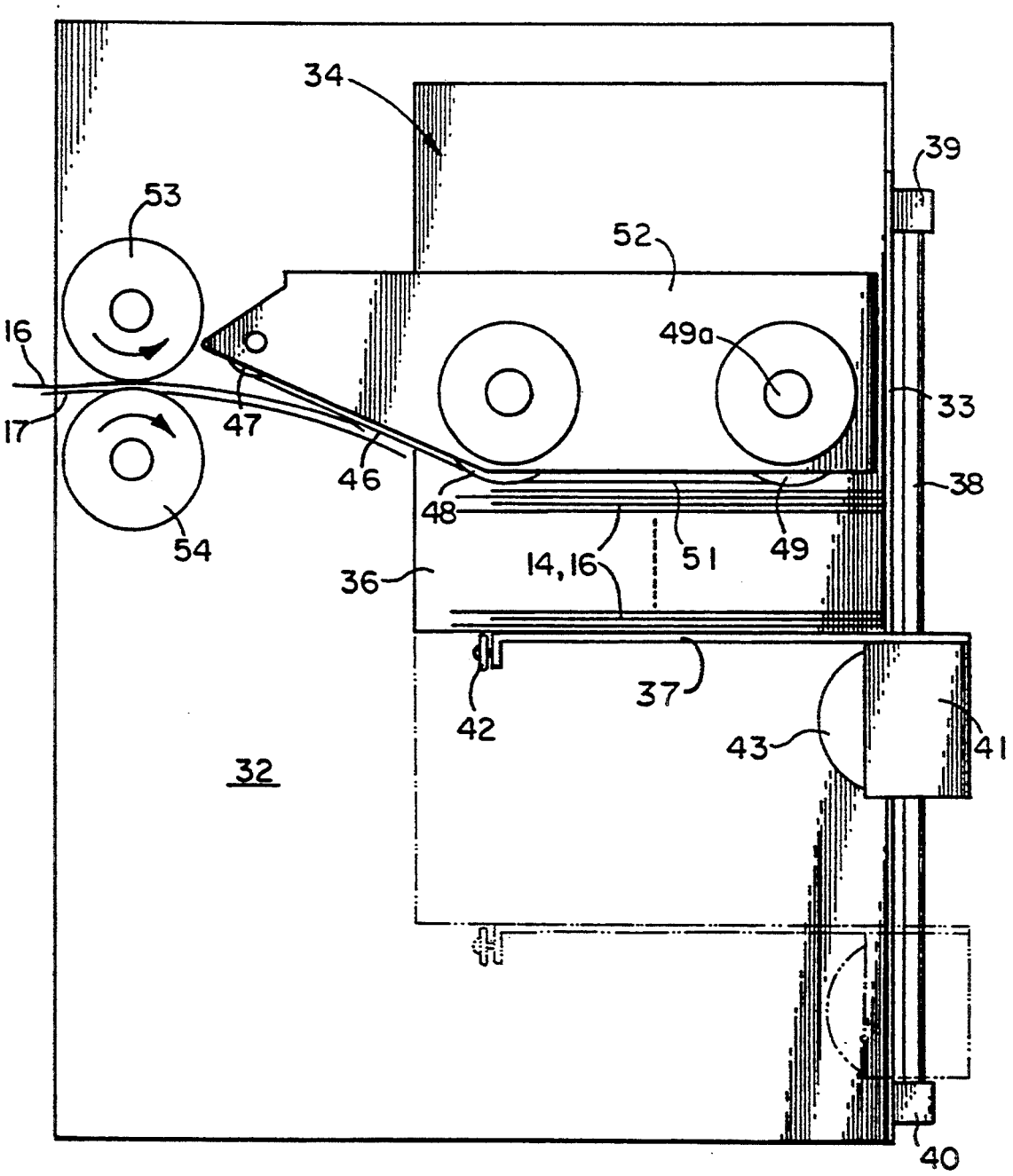
FIG. 5 is a fragmentary top plan view of the embodiment of FIG. 1.

Thus, if one of the two documents should get ahead of the other on the conveyor, the two documents will be properly aligned when they leave the gate. In FIG. 2, the check 16 is shown in solid lines as trailing the coupon 14 as it passes the sensor, and it is shown in phantom lines as having been aligned with the coupon at the gate.

From the gate, the contents are delivered to a stacker 29 which has a generally rectangular cabinet 31 with a top wall 32 and an upstanding flange 33 along one side of top wall. A tray 34 is mounted on the top wall for movement between retracted and advanced positions as documents are stacked in it. The tray has a base plate 36 and a wall or flange 37 against which the documents are stacked.

One side of the tray is suspended from a horizontally extending rail 38 which is mounted on a pair of posts 39, 40 which extend in an upward direction from the cabinet flange. A bearing block 41 affixed to the upper portion of the tray flange rides on the rail. The other side of the tray is supported by a wheel 42 which rides on the upper surface of top wall 32. A roller (not shown) projects through an opening in the top wall and provides support for the tray in a central location. The tray is thus mounted in a manner which permits it to move between its advanced and retracted positions without appreciable friction.

A constant force spring 43 provides means for urging the tray toward its retracted position with a force which remains substantially constant no matter where the tray is in its travel. This spring is mounted on the under side of the bearing block and connected to support post 39. As the tray is pushed away from the retracted position, the spring is unwound, and the tendency of the spring to rewind itself draws the tray back toward the retracted position.

A feed belt 46 feeds documents from output conveyor 12 to the stacking tray. This belt is trained about pulleys 47–49 and runs in a horizontal plane, with run 51 of the belt being substantially parallel to the wall 37 against which the documents are stacked. The pulleys about which the feed belt is trained are rotatively mounted between a pair of spaced apart parallel plates 52 which are mounted in a fixed position on the cabinet, with the base plate 36 of the tray passing beneath them.

A pair of feed rollers 53, 54 feed the documents from the conveyor to the stacker belt. The two rollers are positioned on opposite sides of the document path and engage different ones of the two documents. The rollers are driven at speeds such that the document on the opposite side of the path from the stacker belt travels faster than the document closer to the belt so that it reaches the belt first. This assures that this document will engage the belt and be properly drawn into the tray. Thus, the document closer to the stacking wall is fed into the tray slightly ahead of the other document (typically about one inch), and this has been found to provide a significant improvement in the orderliness of the stack of documents in the tray.

Roller 54 is mounted on an adjustable mount 55 which permits the spacing between the two feed rollers to be adjusted. The rollers are preferably close enough together to assure the each document will be engaged by a roller, but with a small gap between them so that they will not contact each other when no documents are present.

A drive motor 56 for the feed rollers and stacker belt is mounted inside the cabinet, and a drive belt 57 is trained about a drive pulley 58 affixed to the motor shaft. This belt is trained about a pulley 59 affixed to the shaft **49*a* of pulley 49 and about a pulley (not shown) affixed to the shaft 53*a* of feed roller 53. Tension is maintained in the drive belt by an idler pulley 61**.

Feed roller 54 is driven by a belt 63 trained about a drive pulley 64 affixed to shaft **53*a* and a pulley 66 affixed to the shaft 54*a* of roller 54. Tension is maintained in belt 63 by an idler pulley 67. In the embodiment illustrated, feed rollers 53, 54 are substantially equal in diameter, and the diameter of drive pulley 64 is approximately twice the diameter of pulley 66** to provide the desired differential in the speeds at which the two documents are driven.

A sensor 69 is mounted in an opening in the top wall of the cabinet for engagement by wheel 42 when the tray is full. This sensor is connected to the control circuitry for the system and turns off conveyor 12 and drive motor 56 when actuated.

Additional sensors (not shown) are provided at various points along the path of the documents for shutting down the system in the event of a jam. Such sensors are, for example, positioned along conveyor 12 and between feed rollers 53, 54 and stacker belt 46.

Operation and use of the apparatus, and therein the method of the invention, is a follows. As documents such as remittance coupons 16 and checks 17 travel along the path of conveyor 12, they are stopped by gate arm 21 when the gate is in its closed position. When the last trailing edge of the documents from a particular envelope passes sensor 26, timer 27 is actuated to open the gate after the leading edge of the trailing document has had time to reach the gate and get aligned with the leading edge of the other document.

When the gate opens, feed rollers 53, 54 feed the documents toward stacking belt 46, with the document farther from the belt (coupon 16, in this example) being fed ahead of the other document (check 17, in this example). As the documents reach the belt, they are fed into the tray and stacked between the belt and wall 37, with their leading edges abutting against side wall 33. As each new document is added to the stack, the tray moves away from the belt against the force of spring 43. This force remains substantially constant throughout the travel of the tray, assuring uniform, consistent stacking regardless of the number of documents in the tray.

It is apparent from the foregoing that a new and improved remittance processing apparatus and method have been provided. While only certain presently preferred embodiments have been described in detail, as will be apparent to those familiar with the art, certain changes and modifications can be made without departing from the scope of the invention as defined by the following claims.

We claim:

1. In apparatus for processing documents such as payment coupons and checks extracted from envelopes: means for conveying a pair of documents along a path, gate means engagable with leading edges of the documents for controlling passage of the documents along the path, means for holding the gate means in a closed position for blocking engagement with the documents until the leading edges are aligned with each other and thereafter opening the gate means to release the documents, a stacker tray, a stacker belt for feeding the documents into the stacker tray, a constant force spring yieldably urging the tray toward the belt, and a pair of feed rollers engagable with respective ones of the documents as they are released by the gate means for feeding the two documents toward the stacker belt at different speeds so that the one of the two documents is fed into the stacker tray ahead of the other.

2. The apparatus of claim 1 wherein the means for holding and opening the gate means includes a sensor for monitoring the presence of documents at a point along the path prior to the gate means, and timing means responsive to the sensor for holding the gate means in the closed position for a predetermined period of time after the documents have passed the sensor.

3. In apparatus for processing documents conveyed in groups along a path: a gate arm movable between open and closed positions for controlling passage of documents along the path, means for holding the gate arm in the closed position for blocking engagement with leading edges of documents travelling along the path, sensing means for detecting the presence of documents at a point along the path prior to the gate arm, and means responsive to the sensing means for moving the gate arm to the open position a predetermined time after all of the documents in a group have moved past the sensor, said predetermined time being long enough to permit the leading edges of all of the documents in the group to reach the gate arm.

4. In apparatus for processing a pair of documents conveyed in face to face alignment along a path, a pair of feed rollers positioned on opposite sides of the path for engagement with respective ones of the documents, a feed belt positioned on one side of the path, and means for rotating the feed rollers at speeds such that the document on the side of the path opposite the feed belt is advanced toward the belt ahead of the document on the same side of the path as the belt.

5. An apparatus for stacking documents received from a conveyor: a tray having a horizontally extending rigid base plate and an upstanding wall extending along a side of the base plate opposite the conveyor, means for feeding documents from the conveyor onto the tray in an upright position with lower edges of the documents resting on the rigid base plate and major surfaces of the documents generally parallel to the wall, a stationary support positioned beneath the tray, at least one roller supporting the tray on the support for substantially frictionless movement away from the conveyor as the documents are fed onto the tray, and constant force spring means connected to the tray for resisting movement of the tray away from the conveyor with a substantially constant force regardless of the number of documents stacked on the tray.

6. In a method of processing documents such as payment coupons and checks extracted from envelopes, the steps of: conveying a pair of documents along a path, engaging leading edges of the documents with a gate to control passage of the documents along the path, holding the gate in a closed position until the leading edges are aligned with each other and thereafter opening the gate to release the documents, engaging the documents released by the gate with feed rollers rotating at speeds such that one of the two documents is fed ahead of the other, feeding the documents from the rollers into a stacking tray with a stacking belt which engages one side of the documents, and urging the tray toward the belt with a force which remains substantially constant regardless of the number of documents stacked in the tray.

7. The method of claim 6 including the steps of monitoring the presence of documents at a point along the path prior to the gate, and holding the gate in the closed position for a predetermined period of time after the documents have passed the sensor.

8. In a method of processing documents conveyed in groups along a path, the steps of: holding a gate arm in a closed position for blocking engagement with leading edges of documents travelling along the path, detecting the presence of documents at a point along the path prior to the gate arm, and moving the gate arm to an open position a predetermined time after all of the documents in a group have moved past the sensor, said predetermined time being long enough to permit the leading edges of all of the documents in the group to reach the gate arm.

9. In a method of processing a pair of documents conveyed in face to face alignment along a path, the steps of: engaging the documents with a pair of feed rollers positioned on opposite sides of the path to feed the documents toward a belt positioned on one side of the path, and rotating the feed rollers at speeds such that the document on the side of the path opposite the belt is advanced toward the belt ahead of the document on the same side of the path as the belt.

10. In apparatus for stacking documents: a rigid tray having first and second mutually perpendicular document supporting surfaces, means for feeding documents onto the tray with lower edges of the documents resting on the first supporting surface and major surfaces of the documents facing the second supporting surface, a stationary support means Including at least one toiler mounting the rigid tray on the stationary support for substantially frictionless movement away from the feeding means as the documents are fed onto the tray and stacked against the second supporting surface, and means for resisting the movement of the tray with a substantially constant force regardless of the number of documents stacked on the tray.

11. The apparatus of claim 10 wherein the rigid tray includes a rigid, horizontally extending base plate which forms the first supporting surface, and an upstanding side flange along one elongated side of the rigid base plate which forms the second supporting surface.

12. In apparatus for stacking documents: a tray having fist and second mutually perpendicular document supporting surfaces, means for feeding documents onto the tray with lower edges of the documents resting on the first supporting surface and major surfaces Of the documents facing the second supporting surface, a rail, a bearing block which is affixed to one side of the tray and rides upon the rail, a wheel mounted on a side of the tray opposite the bearing block and in rolling engagement with a stationary support surface, a roller projecting above the support surface in rolling engagement with the under side of the tray, and means for resisting the movement of the tray away from the feeding means with a substantially constant force regardless of the number of documents stacked on the tray.

* * * * *